US006808177B2

(12) United States Patent
Dehart

(10) Patent No.: US 6,808,177 B2
(45) Date of Patent: Oct. 26, 2004

(54) TARGET SYSTEM

(75) Inventor: Jim Dehart, Moyock, NC (US)

(73) Assignee: Blackwater Target Systems LLC, Moyock, NC (US)

( * ) Notice: Subject to any disclaimer, the term of this patent is extended or adjusted under 35 U.S.C. 154(b) by 0 days.

(21) Appl. No.: 10/125,434

(22) Filed: Apr. 19, 2002

(65) Prior Publication Data

US 2002/0158413 A1 Oct. 31, 2002

Related U.S. Application Data

(60) Provisional application No. 60/286,374, filed on Apr. 26, 2001, and provisional application No. 60/331,223, filed on Nov. 13, 2001.

(51) Int. Cl.[7] ..... F41J 1/10

(52) U.S. Cl. ..... 273/406; 273/407; 273/354; 273/390

(58) Field of Search ..... 273/406, 407, 273/390–392, 359

(56) References Cited

U.S. PATENT DOCUMENTS

| | | | | |
|---|---|---|---|---|
| 668,219 A | * | 2/1901 | Rock | 273/366 |
| 2,125,353 A | | 8/1938 | Mattson | |
| 2,883,194 A | | 4/1959 | Bogner et al. | |
| 2,931,655 A | | 4/1960 | Hudkins | |
| 3,559,994 A | * | 2/1971 | Larsen | 273/406 |
| 3,614,102 A | | 10/1971 | Nikoden, Sr. | |
| 3,647,214 A | * | 3/1972 | Hohmann | 273/392 |
| 3,815,914 A | | 6/1974 | Nikoden, Jr. | |
| 3,865,373 A | | 2/1975 | Knight | |
| 3,914,879 A | | 10/1975 | Taylor, III et al. | |
| 4,142,723 A | | 3/1979 | Rief | |
| RE30,013 E | | 5/1979 | Knight | |
| 4,189,147 A | | 2/1980 | Schmid | |
| 4,195,840 A | | 4/1980 | Spieth et al. | |
| 4,261,579 A | | 4/1981 | Bowyer et al. | |
| 4,266,776 A | | 5/1981 | Goldfarb | |
| 4,330,129 A | | 5/1982 | Meredith | |
| 4,437,671 A | | 3/1984 | Busch | |
| 4,501,427 A | | 2/1985 | Payne | |
| 4,540,182 A | | 9/1985 | Clement | |
| 4,550,918 A | | 11/1985 | Motsenbocker | |
| 4,588,194 A | | 5/1986 | Steidle et al. | |
| 4,898,391 A | | 2/1990 | Kelly et al. | |
| 4,911,453 A | | 3/1990 | Essex et al. | |
| 5,088,741 A | | 2/1992 | Simonetti | |
| 5,213,336 A | | 5/1993 | Bateman | |
| 5,248,150 A | | 9/1993 | Koma | |
| 5,257,790 A | | 11/1993 | Meadows | |
| 5,263,722 A | | 11/1993 | Rosellen | |
| 5,281,142 A | | 1/1994 | Zaenglein, Jr. | |
| 5,324,043 A | | 6/1994 | Estrella | |
| 5,340,116 A | * | 8/1994 | Reinart | 273/391 |
| 5,342,062 A | * | 8/1994 | Lance | 273/391 |
| 5,350,180 A | | 9/1994 | Acock | |
| 5,403,017 A | | 4/1995 | Doss, III et al. | |

(List continued on next page.)

FOREIGN PATENT DOCUMENTS

| | | |
|---|---|---|
| DE | 3814281 A | 12/1988 |
| JP | 9-257397 | 10/1997 |

OTHER PUBLICATIONS

PCT International Search Report for PCT/US02/12416; date of mailing, Aug. 27, 2001.

*Primary Examiner*—Mark S. Graham
(74) *Attorney, Agent, or Firm*—Nixon Peabody LLP; Donald R. Studebaker

(57) ABSTRACT

A target system provides a unified target solution where a plurality of targets are fixed to a base member. This base member allows, for example, easy portability of the plurality of targets as well as provides a mechanism for allowing multiple targets systems to be interconnected and interchanged.

22 Claims, 8 Drawing Sheets

U.S. PATENT DOCUMENTS 5,431,409 A 7/1995 Webster
5,603,505 A 2/1997 Acock
5,738,584 A 4/1998 Ikematsu et al.
5,868,396 A 2/1999 Theissen
5,934,678 A 8/1999 Theissen et al.
5,938,203 A 8/1999 Beckwith, Sr.
5,947,477 A * 9/1999 Turnipseed ..... 273/407
5,951,016 A 9/1999 Bateman
6,007,429 A 12/1999 Lubniewski
6,073,932 A 6/2000 Elliott

* cited by examiner

TARGET SYSTEM

RELATED APPLICATION DATA

This application claims the benefit of and priority under 35 U.S.C. §119(e) to U.S. patent application Ser. No. 60/286,374, filed Apr. 26, 2001 entitled, "Target Systems," and U.S. patent application Ser. No. 60/331,223, filed Nov. 13, 2001 entitled, "Mobile Target Systems," both of which are incorporated herein by reference in their entirety.

BACKGROUND OF THE INVENTION

1. Field of the Invention

The invention generally relates to target systems. In particular, the invention relates to a target system having multiple targets.

2. Description of Related Art

A variety of different types of targets are available depending on, for example, specific requirements or training practices of a shooter. These targets can range from paper targets, to static targets, such as steel or paper, to moving steel, paper targets, or the like, and are generally arranged at a distant end of a shooting range. Each of the targets can generally be moved around and configured within the range depending on, for example, a particular training drill for a shooter.

SUMMARY OF THE INVENTION

While existing target systems are known that allow individual targets to be moved and manipulated, existing systems at least fail to provide a unified target solution.

An exemplary embodiment of this invention provides a unified target solution where a plurality of targets are fixed to a base member. This base member allows, for example, easy portability of the plurality of targets as well as provides a mechanism for allowing multiple targets systems to be interconnected.

For example, the target system can include a plurality of targets, such as movable plates, static plates, turners, plate racks, movers, and the like. An actuating mechanism allows one or more of the various targets to further be moved based on, for example, one or more of a custom automation sequence, an automatic automation sequence, or the like.

Furthermore, and in accordance with second exemplary embodiment of this invention, the target system can be integrated onto a trailer such that the target system can be transported between, for example, one or more target ranges. This provides, for example, a portable target solution that can be very quickly set-up, knocked down and easily moved.

Aspects of the present invention relate to a target system. In particular, aspects of the present invention related to a target system having a plurality of targets.

Aspects of the present invention also relate to a target system having a plurality of static and dynamic targets.

Furthermore, aspects of the present invention relate to a mobile target system.

Additionally, aspects of the present invention relate to a target system that is capable of being trailered to a given destination.

Aspects of the present invention also relate to a target system that can be scaleably combined with one or more other target systems.

Aspects of the present invention further relate to a target system having one or more moveable targets that can be activated or reset in, for example, a predetermined sequence.

Aspects of the present invention additionally relate to a target system having a plurality of targets which can all be moved with one unified structure.

These and other features and advantages of this invention are described in or are apparent from the following detailed description of the embodiments.

BRIEF DESCRIPTION OF THE DRAWINGS

The embodiments of this invention will be described in detailed, with reference to the following figures wherein.

DETAILED DESCRIPTION

Figure 1:
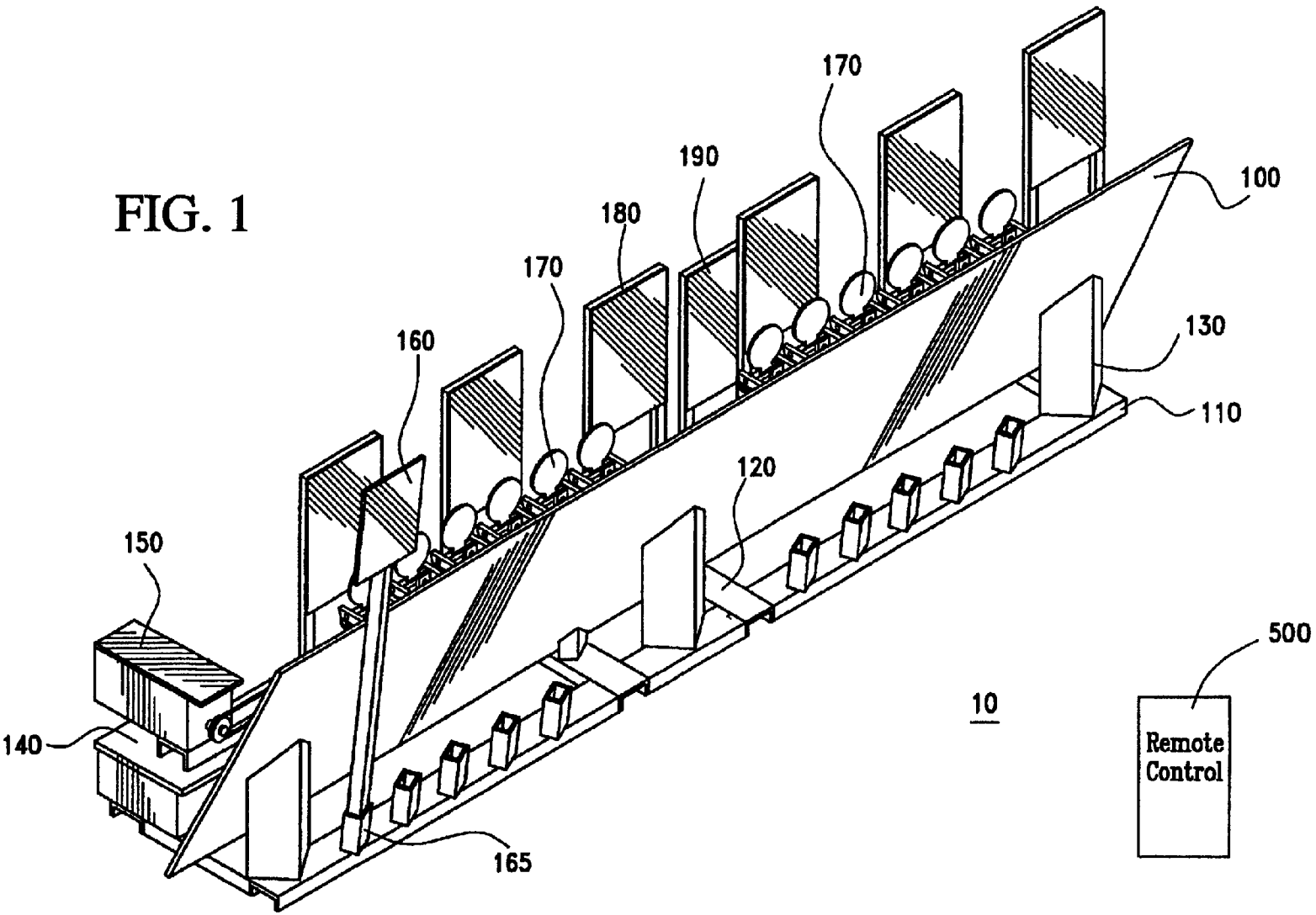
FIG. 1 is a perspective view of an exemplary embodiment of the target system according to this invention.

FIG. 1 illustrates an exemplary target system 10 according to this invention. In particular, the target system 10 comprises a front plate 100, a base 110, a lift point 120, a plurality of supports 130, a power distribution unit 140, a mover control unit 150, one or more static plates 160, one or more plate racks 170, that include one or more plates, one or more turners 180 and one or more movers 190.

The exemplary systems and methods of this invention will be described in relation to a target system. However, to avoid unnecessarily obscuring the present invention, the following description omits well-known structures and devices that may be shown in block diagram form or otherwise summarized. For the purposes of explanation, numerous specific details are set forth in order to provide a thorough understanding of the present invention. In should be appreciated however that the present invention may be practiced in a variety of ways beyond these specific details.

For example, while the present invention will be disclosed in the context of a single target system 10, one of ordinary skill in the art will recognize that a plurality of target systems 10 can be aligned and interconnected, for example, side-byside, to provide a scaleable target solution based on one or more targets systems 10.

Figure 3:
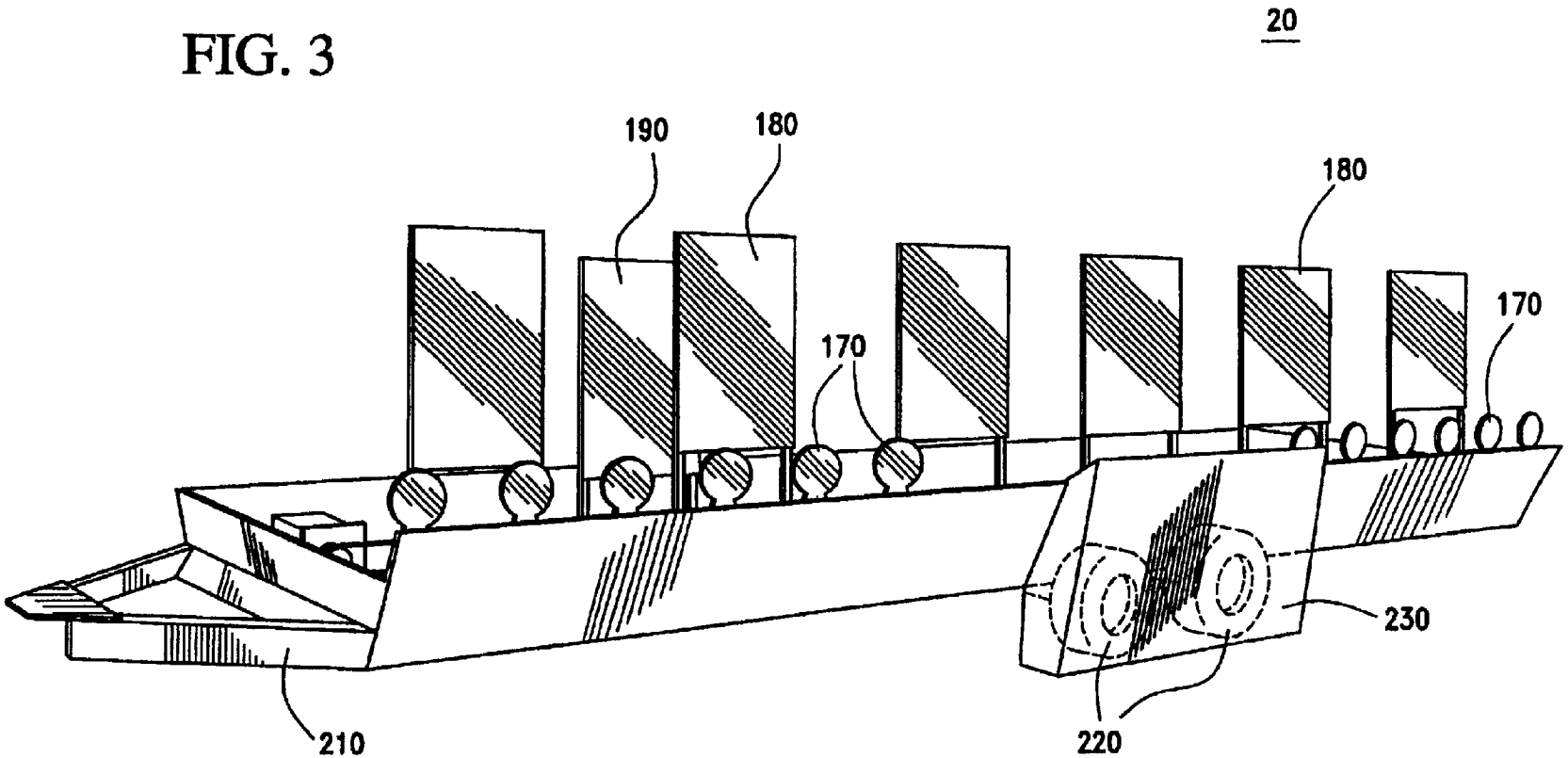
FIG. 3 is a perspective view of a second exemplary embodiment of the target system according to this invention.

Furthermore, it should be appreciated that as discussed in relation to FIG. 3, the target system 10 can be incorporated onto, for example, a trailer or self-propelled machine. While the following description is directed toward a particular target system configuration, it is to be appreciated that the various components of the target system can be rearranged, supplemented or omitted without affecting the overall operability of the system.

In operation, the target system 10 is delivered to a location. For example, a fork lift, utilizing the lift point 120, can lift the target system into position. Upon placement of he target system 10 into position, the base 110 can be, for example, partially covered by sand or other suitable aggregate, to aid in the trapping of bullets and/or bullet fragments.

In combination with the general overall design of the target system 10, and, for example, to increase safety, surfaces substantially perpendicular to the trajectory of oncoming munitions can be reduced. For example, the support members 130 and the front face 100 can be arranged so as to reduce the total number of surfaces substantially perpendicular to the trajectory of incoming munitions. This design concept can be extended, for example, to the static plate receivers 165 and any other surface that may be subject to direct line-of-fire contact.

One or more static plates 160 can be placed in the one or more static plate receivers 165. The static plate(s) 160 can be of varying height, size and shape and can also be tilted so as to reduce substantially perpendicular surfaces as discussed above. In addition to the static plates 160, one or more sets of plate racks 170, each comprising one or more plates that can, for example, be individually knocked down, are removably fixed to the target system 10. For example, the plate racks 170 can be located for example, behind the front plate 100 and in front of the turners 180. The plates in the plate rack 170, as discussed hereinafter, can be righted at any time through the use of a righting mechanism. Furthermore, as with all targets used in conjunction with the target system, the plates can be of varying height, size and shape and material. Specifically, it may be desirable to make the plates out of a durable material, such as AR500 steel, while the movers and turners could be a replaceable paper or a cardboard target.

One or more turners 180 are located, for example, behind the plate racks 170 and in front of the mover 190. The turners 180 can, for example, be activated to turn along an axis perpendicular to longitudinal, as discussed hereinafter, or alternatively, pivotal to axis parallel to longitudinal. However, it should be appreciated that the turners 180 can be generally configured to operate in any orientation. Furthermore, as will be discussed hereinafter in relation to the power distribution and control unit 140, the turners 180 can be turned individually, in groups, or all unison.

The mover 190 can be located, for example, behind the turners 180 and be configured to traverse longitudinally along the target system 10. For example, in cooperation with the mover control unit 150, the speed, distance and stopping of the mover 190 can be configured. For example, the mover 190 can be configured to proceed to a first location on the target system 10, stop for 5 seconds, proceed to a second location, stop for 3 seconds, or the like. Thus, as will be apparent throughout the remainder of the specification, the number of individual targets within the target system 110, the position, the selection, the type and the automation of the targets can be configured to meet the demands of, for example, a particular training exercise.

The power distribution and control unit 140 allows, for example, the target system 10 to be substantially self-contained and thus more portable. For example, the power distribution and control unit 140 can contain one or more, or a combination of, pneumatic pumps, hydraulic pumps, electromechanical actuation control devices, generators, or the like. Furthermore, the power distribution and control unit 140 can include a controller interface that allows for the activation of targets, such as the turners 180 or the mover 190, the resetting of one or more plates on the plate rack 170, or the like. This controller interface can be integrated into the power distribution and control unit for 140, or, alternatively, connected via a wired or wireless link to a remote control interface 500 which allows for the remote programming and activation of the various targets on the target system 110. For example, the control interface can allow full automation of the target system, such as to run a predetermined sequence of events at the target system 10, can be user configurable to automatically manipulate targets within the target system 10, or, for example, can provide real-time resetting and/or movement of the targets by, for example, a user.

Figure 2:
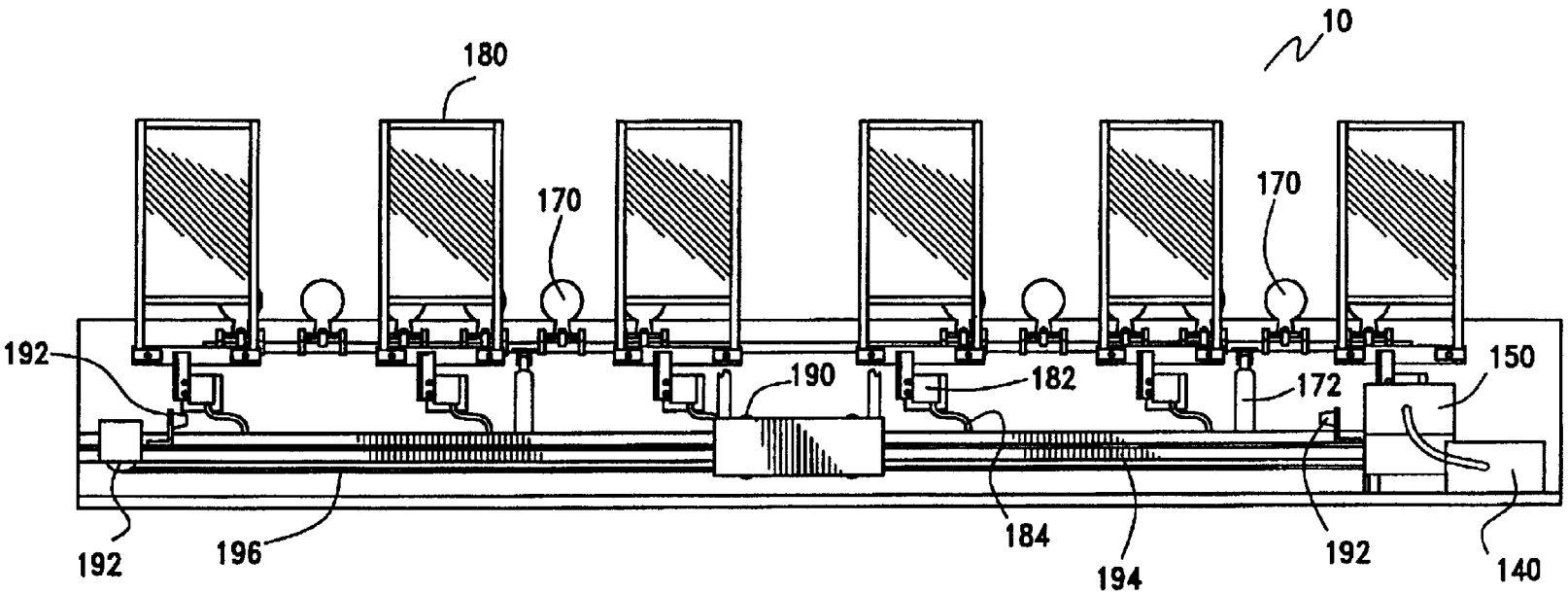
FIG. 2 is a rear elevational view of exemplary embodiment of the target system according to this invention.

FIG. 2 illustrates a rear elevationally view of the target system 10. In particular, FIG. 2 highlights an exemplary configuration of the mechanism for moving the mover 190 and a turning mechanism 182 for the turners 180. In particular, the turners 180 are removably connected to a turning unit 182. This turning unit 182 is connected, via connector 184, to the power distribution and control unit 140. For example, the connector 184 can be a pneumatic connector, hydraulic connector, an electrical connector, or alternatively, the turning unit 182 may interact with the power distribution and control unit 140 wirelessly. The turning unit 182 is configured such that the turner 180 is capable of turning along an axis substantially perpendicular to longitudinal. Alternatively, the turner 180, and associated turning unit 182, can be configured, such that the turner 180 is capable of pivoting along an axis substantially parallel to longitudinal. This allows, for example, a "pop-up" type operation of the turner 180. Alternatively, the turner 180 can be configured so as to provide "swing-out" capability so as to swing-out into, for example, a door.

Likewise, the plate racks 170 can be righted by one or more plate rack righting units 172. For example, as illustrated in FIG. 2, each set of six plates is righted via one plate rack righting unit 172. Alternatively, each plate within the plate rack 170 can have its own plate righting unit 172, or, for example, two or more plates can be grouped and have an associated plate rack righting unit 172. Additionally, the plate rack righting unit can be used to lower the plates. Thus, for example, in combination with automating one or more other targets, the plates can be raised and lowered in any sequence and at any time.

The mover 190 traverses along rails 194 in a longitudinal direction. In particular, the mover 190, in cooperation with the mover control unit 150, and, for example, cables 196 and pulleys 197, moves longitudinally between the stops 192. However, as will be appreciated by one of ordinary skill in the art, the mover 190 can be moved back and forth across the target system by any know or later developed system that allows for movement of the mover target 190. Furthermore, the functionality of the mover can be combined with another target's functionality, for example, the turner, such that the mover 190 is capable of traversing the target system 10 as well as "popping-up," or the like.

FIG. 3 illustrates a second exemplary embodiment of the target system according to this invention. In particular, the mobile target system 20 is substantially identical to the target system 10 with the addition of a trailer hitch 210, one or more sets of wheels 220, and a wheel protection mechanism 230. As with the face plate 100, the wheel protection mechanism 130 is configured to be offset from perpendicular to the trajectory direction of incoming bullets. This reduces the possibility of, for example, bullet fragments being ricocheted back to the shooter. As discussed previously, the target system 20 can include any necessary power supply units, such as air pumps, hydraulic pumps and or electric generators so as to allow the target system 20 to be self-contained. Likewise, as with the target system 10, the target system 20 can include a wired or wireless control interface that allows, for example, a computer or user to interact with, reset and/or manage the movement of one or more targets on the target system 20. Additionally, the target system 20 can have (not illustrated) one or more storage compartments to store extra targets, a remote control device, repair parts, and/or the movers and turners in while the target system is being moved.

Figure 4:
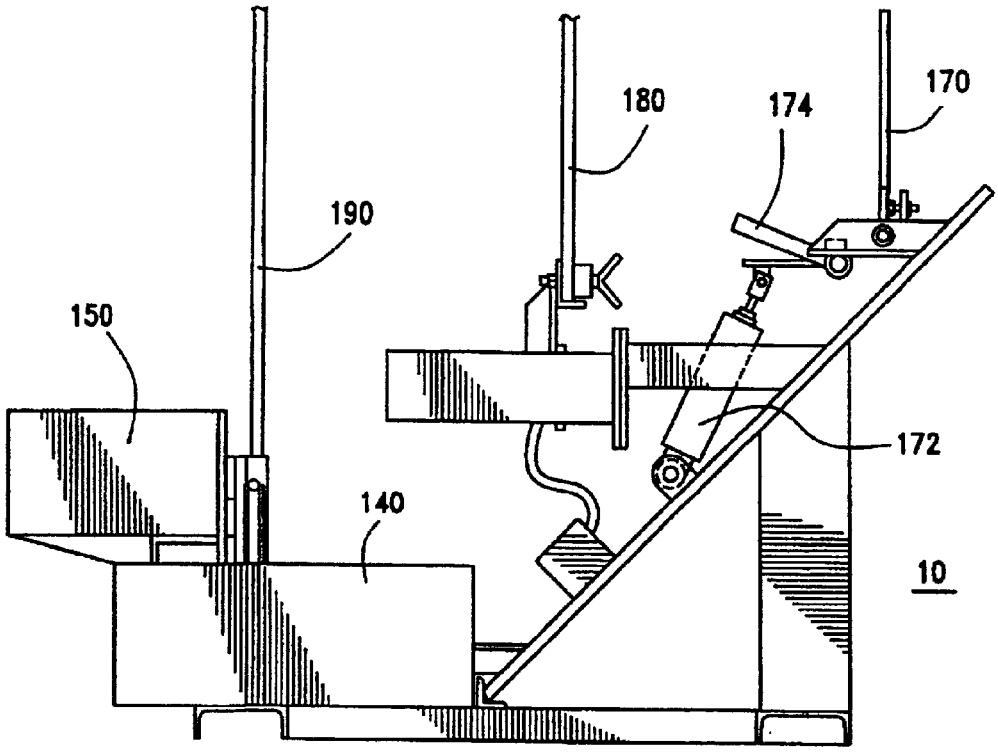
FIG. 4 is a side view of the exemplary target system according to this invention.

FIG. 4 illustrates a side view of an exemplary embodiment of the target system 10. In particular, in FIG. 4, the target system 10 has all targets oriented in a direction substantially perpendicular to a shooting direction. Furthermore, FIG. 4 illustrates how the plate rack righting mechanism 172 cooperates with a plate rack righting lever 174 to right one or more plates on the plate rack 170. Specifically, upon activation, the plate rack righting element 172 interacts with the plate rack righting lever 174 to return one or more plates of the plate rack 170 to the upright position as shown in FIG. 4.

Figure 5:
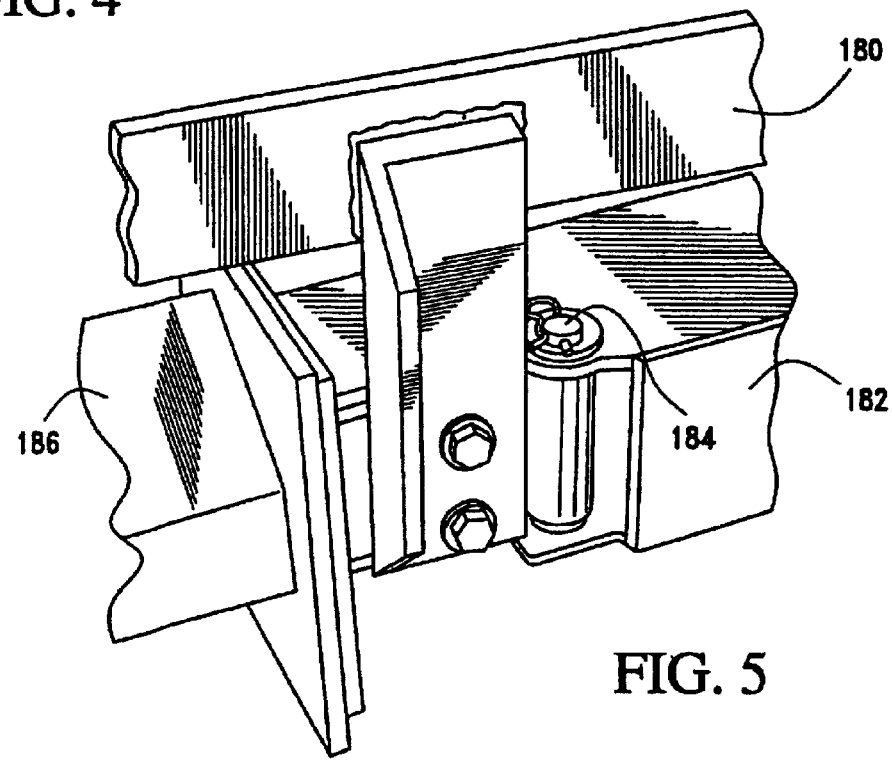
FIG. 5 is a partial perspective view of a turner according to an exemplary embodiment of this invention.

FIG. 5 illustrates a partial perspective view of a turner 180. In particular, the turner 180 as illustrated in FIG. 5 is substantially perpendicular to a shooting direction. Thus, as the turner actuation device 182 is actuated, the turner 180 pivots, on hinge 184, to a direction substantially traverse to a shooting direction. Alternatively, the turner unit device 182 can be rotated 90° and removably fixed to the turner mounting receptacle 185. This would allow, for example, the turner 180 to "pop-up" as opposed to turn toward or away from a shooter.

Figure 8:
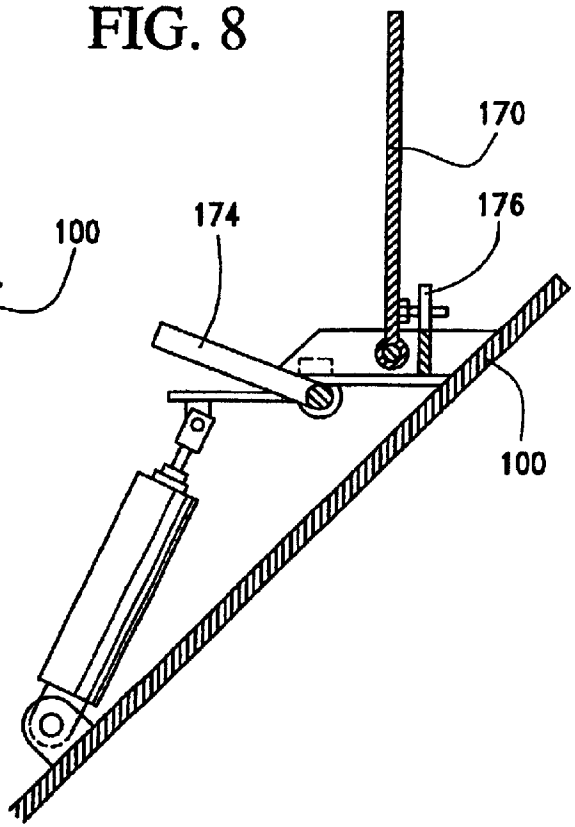
FIG. 8 is a partial side view of a plate rack according to an exemplary embodiment of this invention.
Figure 7:
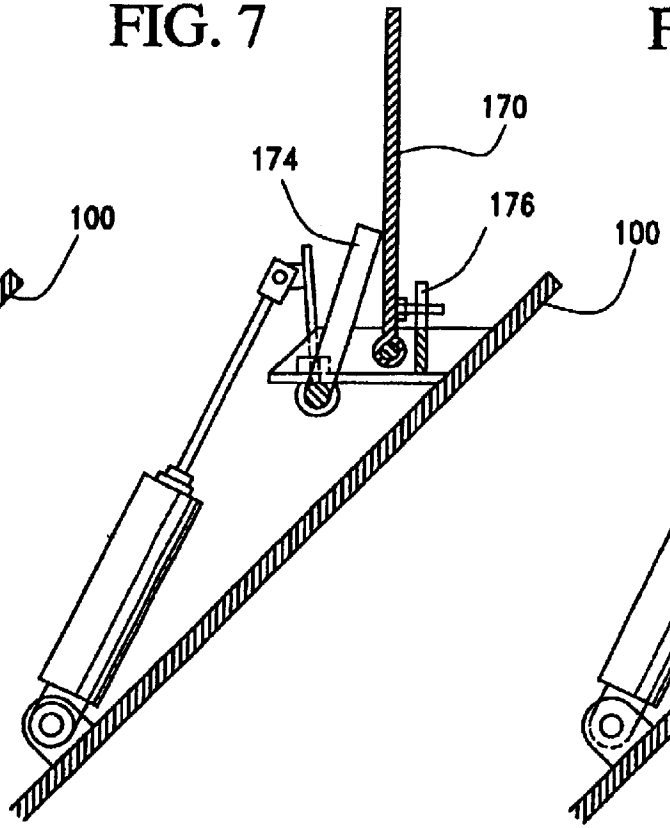
FIG. 7 is a partial side view of a plate rack according to an exemplary embodiment of this invention.
Figure 6:
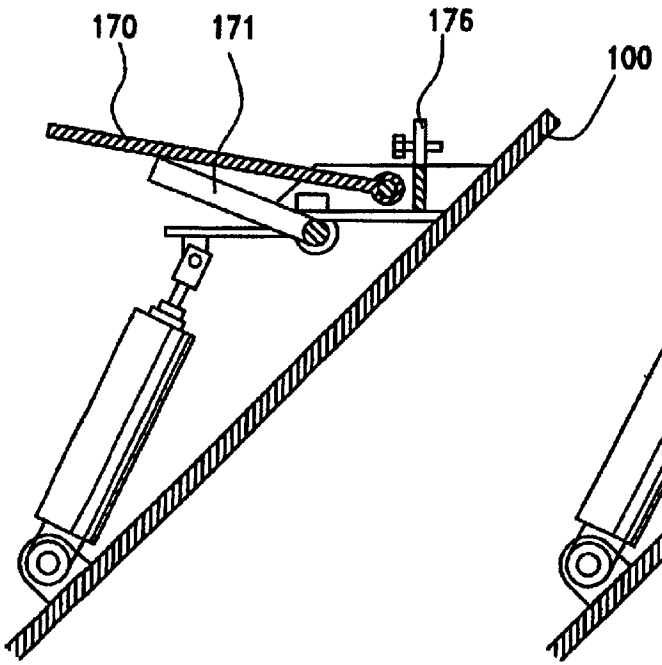
FIG. 6 is a partial side view of a plate rack according to an exemplary embodiment of this invention.

FIGS. 6–8 illustrate the operation of a plate in the plate rack 170 and associated plate rack righting unit 172. In particular, FIG. 6 illustrates the position of a plate 170 after having been, for example, knocked down by a bullet. Here, the plate 170 rests on, for example, the plate rack righting lever 174. Upon activation of the plate rack righting unit 172, and in cooperation with the plate rack righting lever 174, the plate 170 is hingeably rotated and returned to a substantially upright position as illustrated in FIG. 7. This position can be regulated by the plate rack stop assembly 176 and adjusted as needed. Upon returning the plate 170 to a substantially upright position, the plate rack righting unit 172 is returned to a non-extended position (FIG. 8) so as to, for example, reduce shock and interference with the plate 170 when the plate is struck by a projectile.

Figure 10:
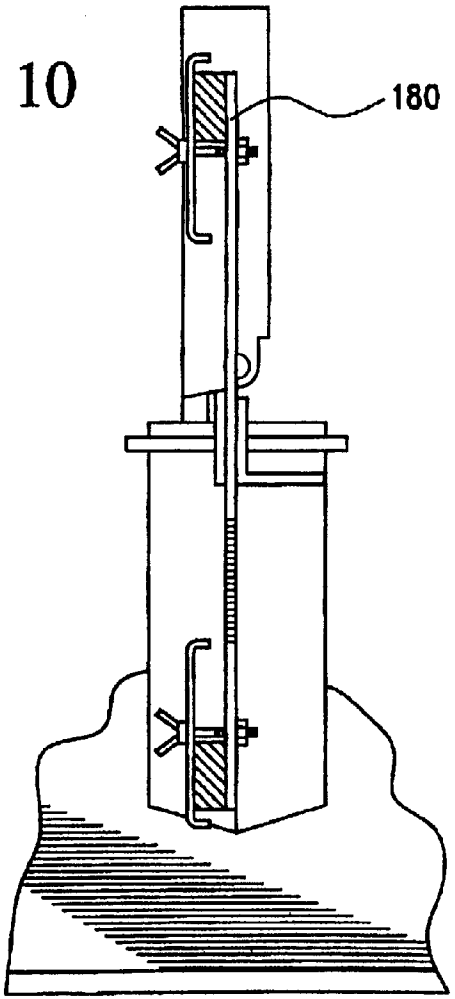
FIG. 10 is top view of a turner assembly according to an exemplary embodiment of this invention.
Figure 9:
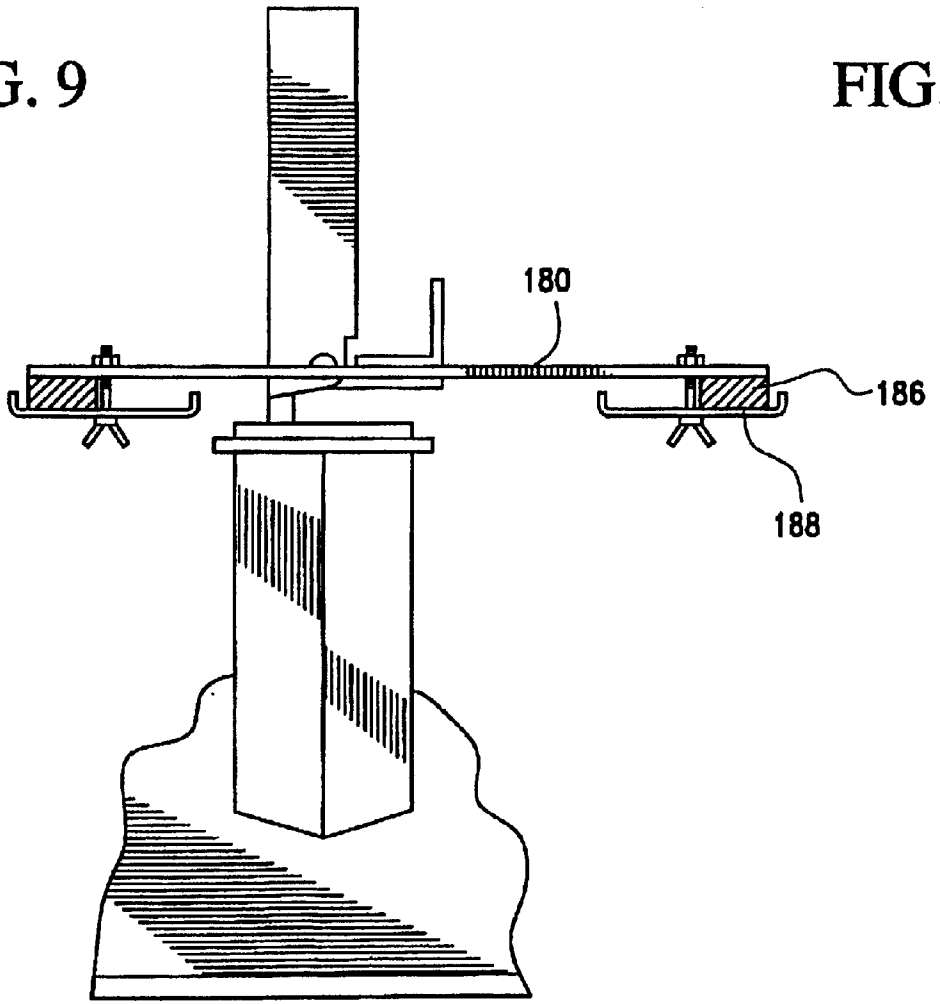
FIG. 9 is a top view of a turner assembly according to an exemplary embodiment of this invention.

FIGS. 9 and 10 illustrate two exemplary operationally positions of the turner 180. In particular, in FIG. 9, the turner 180 is substantially perpendicular to a shooting direction. Alternatively, in FIG. 10, the turner 180 is substantially parallel to a shooting direction. The turner 180 comprises one or more target holders 188 that can, for example, cooperatively grasp a target 186. However, it should be appreciated that any type of attachment mechanism that is capable of holding a target to the turner 180 can be used in cooperation with the systems and methods of this invention without affecting its operability.

In FIG. 10, the turner 180 is substantially "invisible," or parallel to, a shooter. However, upon activation of the turning unit 180, the turner 180 is oriented as illustrated in FIG. 9 such that the shooter can shoot at the target. However, it should be appreciated that based on the type of target placed on the target 180, it may be beneficial to only rotate the turner 180 a predetermined number of degrees. Thus, it should be appreciated that the turner 190 need not be limited to only turning in 90° increments.

Figure 11:
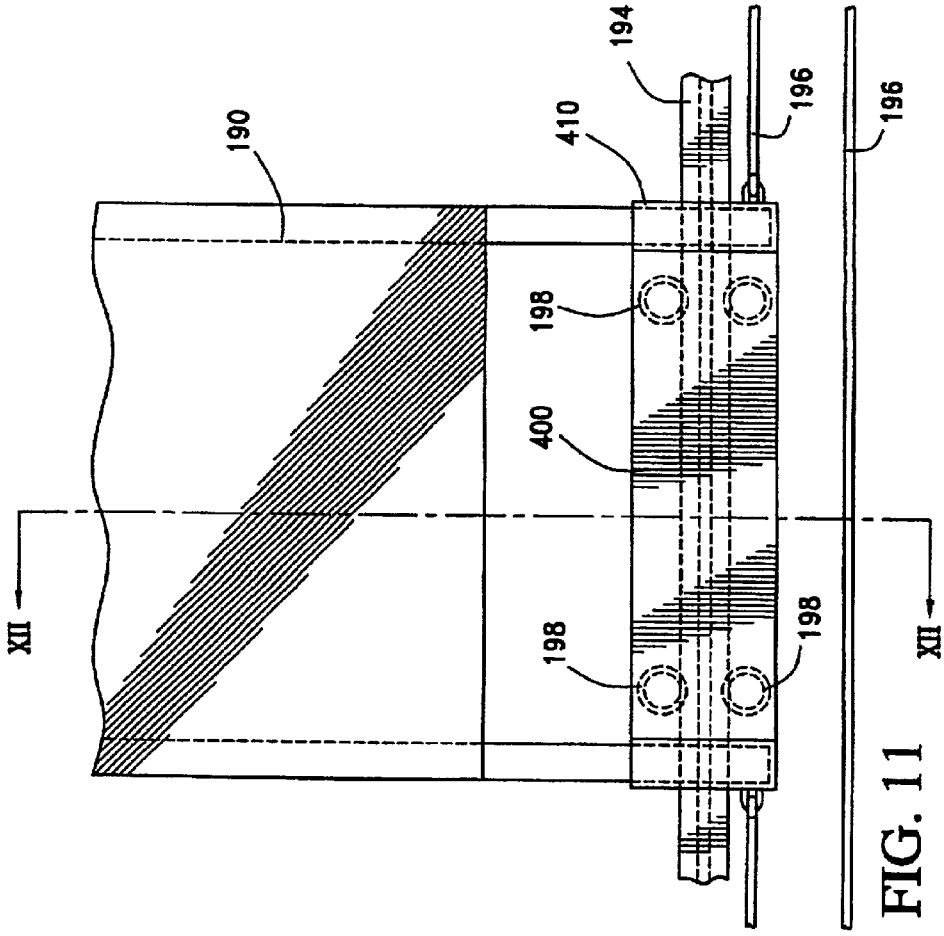
FIG. 11 is partial elevation view of a mover according to an exemplary embodiment of this invention.

FIG. 11 illustrates a partial elevational view of the mover 190. A target portion of the mover 190 is held in a substantially upright direction by receptacles 410 on a mover trolley 400. The mover trolley 400 comprises a plurality of rollers 198 and attaches to cable 196. In particular, mover 190 includes a rail 194, a moving mechanism 196, and one or more rollers 198. The rollers 198 interact with the beam 194 to hold the mover 190 in a substantially upright direction. Furthermore, the rollers 198 allow the mover 190 to traverse longitudinally with the cooperation of the moving mechanism 196, such as a cable, to any position between stops 192.

Figure 12:
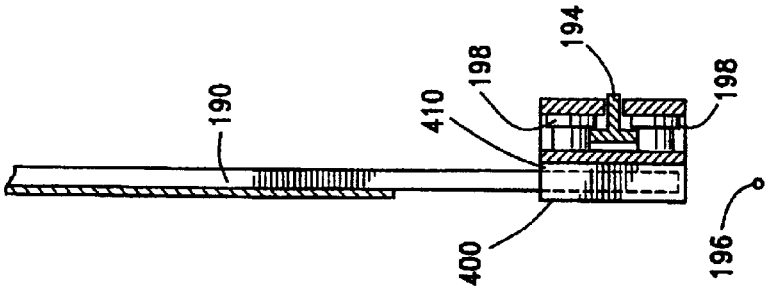
FIG. 12 is a cross-sectional view taken along the XII—XII axis of FIG. 11.

FIG. 12 illustrates a cross-sectional view taken along the XII—XII axis of FIG. 11. As illustrated herein, the target portion of the mover 190 is held in the target receptacle 410. Furthermore, the interaction of the rollers 198 with the rail 194 can be seen.

Figure 13:
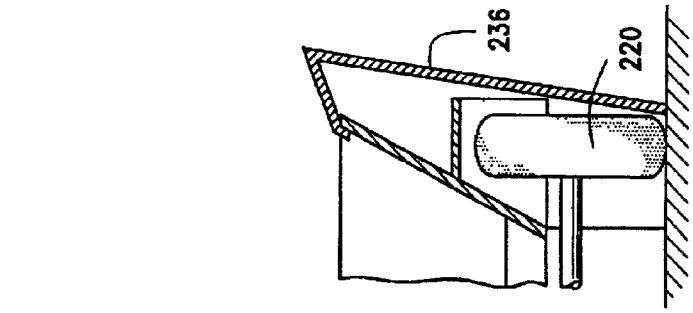
FIG. 13 is a partial side view of the target system according to an exemplary embodiment of this invention.

FIG. 13 illustrates a side view of the tire protection unit 230. The tire protector 230 can be removably fixed to the target system 20 so as to protect the wheels from any bullets or bullet fragments.

Figure 14:
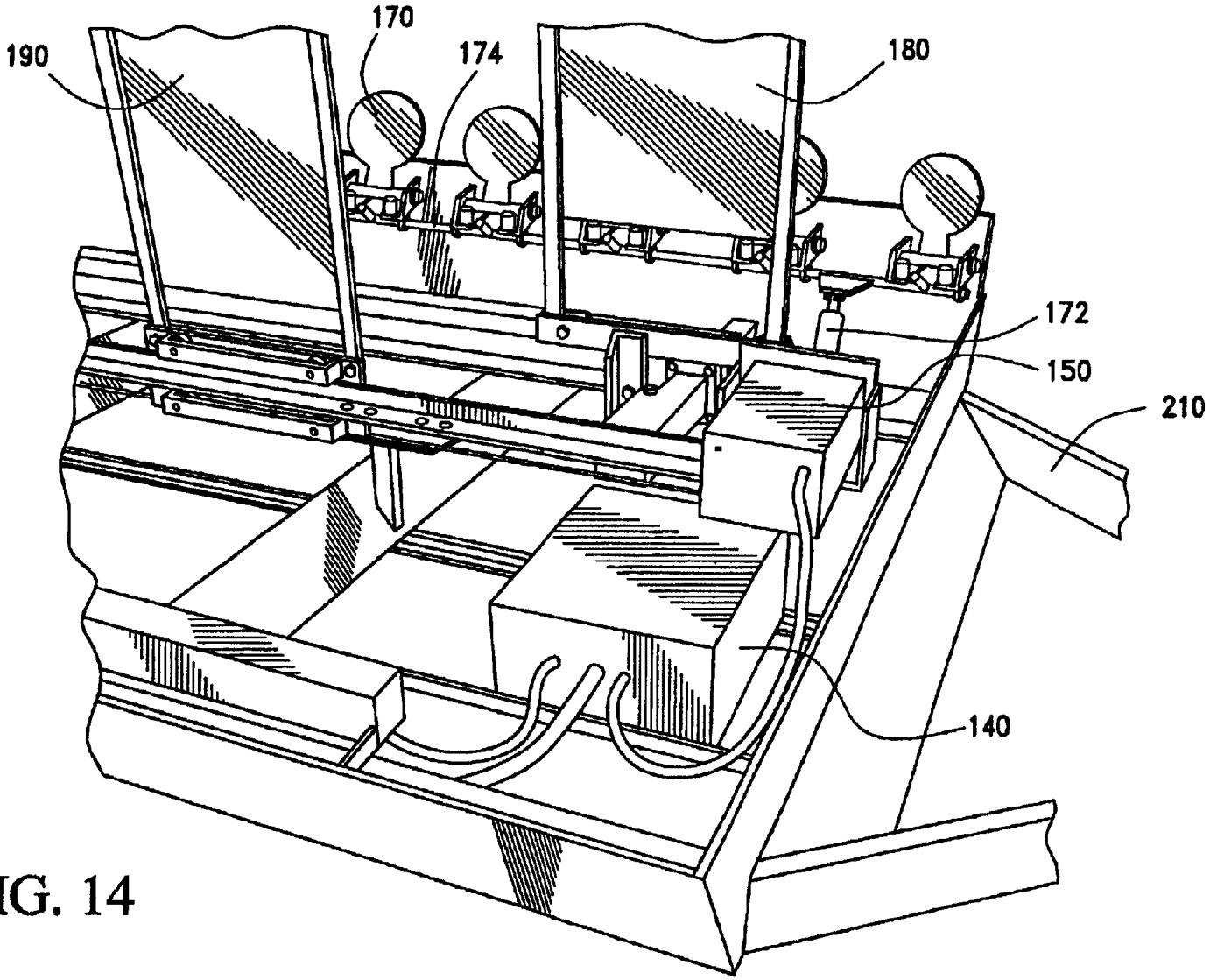
FIG. 14 is a rear partial perspective view of the target system according to an exemplary embodiment of this invention.

FIG. 14 illustrates a partial perspective view of the target system 20. Specifically, an exemplary embodiment is shown where the plate rack righting unit 172 rights a plurality of plates with the cooperation of the plate rack righting lever 174. Here, the plate rack righting lever 174 is elongated to extend such that upon activation of the plate rack righting mechanism, a plurality of plates are righted.

It is, therefore, apparent that there has been provided, in accordance with the present invention, a target system. While this invention has been described in conjunction with a number of embodiments, it is evident that many alternatives, modifications and variations would be or are apparent to those of ordinary skill in the applicable arts. Accordingly, the disclosure is intended to embrace all such alternatives, modifications, equivalents and variations that are within the spirit and scope of this invention.

What is claimed is:

1. A target system comprising:

a base having longitudinal front and rear support surfaces and transverse end support surfaces;

a front deflection plate mounted on the base between the front and rear support surfaces at an acute angle relative to the front support surface;

a plurality of mechanically different target types wherein the plurality of target types include at least one turning target, at least one moveable target type and at least one fixed plate target;

a power drive unit for the at least one turning target and the at least one moveable target type; and a target control interface, wherein the target control interface separately controls the power drive unit for each turning target and each moveable target type, and wherein at least one target type is mounted on an upper surface of the front deflection plate and at least one target type is mounted on the base.

2. The target system of claim 1, wherein the at least one moveable target type includes at least two moveable target types including at least one plate rack and at least one longitudinally moveable target.

3. The target system of claim 2, wherein at least one moveable target type is mounted on the front deflection plate.

4. The target system of claim 2, wherein at least one moveable target type is mounted on the rear support surface.

5. The target system of claim 1, wherein the at least one turning target and the at least one moveable target type are mounted on the front deflection plate.

6. The target system of claim 1, wherein the front support surface includes a plurality of target supports and at least one fixed plate target is removably mounted on a target support.

7. The target system of claim 1, wherein the at least one fixed plate target is removably mounted to the front support surface.

8. The target system of claim 1, wherein the target control interface comprises a remote control for separately controlling the operation of the at least one turning target and each moveable target types.

9. The target system of claim 1, further comprising a trailer forming at least a portion of said base.

10. The target system of claim 1, wherein the target system is mobile.

11. The target system of claim 9, wherein said trailer further comprises a lift point.

12. The target system of claim 1, wherein the at least one turning target is moveable by the power distribution unit in at least one of an axis perpendicular to a longitudinal direction of the target system and a direction pivotal to an axis substantially equal to the longitudinal direction.

13. The target system of claim 9, wherein the trailer further includes a removable wheel protecting mechanism.

14. The target system of claim 2, wherein each plate rack target includes a righting system for righting the plate rack.

15. The target system of claim 2, wherein the at least one longitudinally moveable target includes a mover trolley which traverses along a rail and supports the at least one longitudinally moveable target.

16. The target system of claim 1, wherein the at least one turning target includes a turning mechanism for turning the at least one turning target.

17. The target system of claim 1, further comprising at least a second target system, wherein a first end of a first target system is adjacent to and removably connected to a second end of the second target system.

18. The target system of claim 17, wherein said control interlace controls the power drive unit of each of the target systems.

19. The target system of claim 9, wherein the trailer comprises:

a trailer tongue positioned on the base; and at least two wheels positioned on the base.

20. The target system of claim 18, wherein said at least one moveable target type traverses each of the target systems.

21. A target system comprising:

a base having longitudinal front and rear support surfaces and transverse end support surfaces;

a front deflection plate mounted on the base between the front and rear support surfaces at an acute angle relative to the front support surface;

a plurality of mechanically different target types wherein the plurality of target types include at least one turning target and at least one moveable target type;

a power drive unit for the at least one turning target and the at least one moveable target type; and a target control interface, wherein the target control interface separately controls the power drive unit for each turning target and each moveable target type, and wherein at least one target type is mounted on an upper surface of the front deflection plate and at least one target type is mounted on the base.

22. A target system comprising:

a base having longitudinal front and rear support surfaces and transverse end support surfaces;

a front deflection plate mounted on the base between the front and rear support surfaces at an acute angle relative to the front support surface;

a plurality of mechanically different target types wherein the plurality of target types include at least two moveable target types and at least one fixed plate target;

a power drive unit for each at least one moveable target type; and a target control interface, wherein the target control interface separately controls the power drive unit for each moveable target type, and wherein at least one target type is mounted on an upper surface of the front deflection plate and at least one target type is mounted on the base.

* * * * *